US006106138A

United States Patent [19]

Wei

[11] Patent Number: 6,106,138

[45] Date of Patent: Aug. 22, 2000

[54] STRUCTURE OF A WIRE CLIPPER FOR USING IN A NET-LIKE LAMP STRING

[76] Inventor: Jung-Kuei Wei, No. 113, SanChiaoLi, SanLi Tsung, LungTan Hsiang, TaoYuan Hsine, Taiwan

[21] Appl. No.: 09/264,358

[22] Filed: Mar. 8, 1999

[51] Int. Cl.[7] ..... F21W 121/00

[52] U.S. Cl. ..... 362/252; 362/249; 362/391; 362/396

[58] Field of Search ..... 362/252, 249, 362/226, 123, 396, 806, 391

[56] References Cited

U.S. PATENT DOCUMENTS

| | | | |
|---|---|---|---|
| 5,662,409 | 9/1997 | Huang | 362/249 |
| 5,697,698 | 12/1997 | Huang | 362/249 X |
| 5,716,124 | 2/1998 | Hsu | 362/252 |
| 5,775,802 | 7/1998 | Kuo | 362/249 X |
| 5,791,765 | 8/1998 | Lin | 362/391 X |
| 5,941,628 | 8/1999 | Chang | 362/249 |

*Primary Examiner*—Laura K. Tso

[57] ABSTRACT

A lamp string wire clipper for joining two sets of wires of a lamp string together comprises a holder and a lamp seat. The holder is formed by a first portion and a second portion, the first portion includes three trenches, a pin and a convex portion, the second portion including three trenches, a pin hole and a convex portion. The lamp seat includes a through hole and a via hole. After assembling with a lamp, two electric wires connected with a lamp is inserted in the through hole, a set of trenches enclose the via hole so that the convex portions align with the hole opening, one end of one of the two electric wire passes through the through hole enclosing by the first trenches, a further electric wire passes through the through hole enclosed by the third trenches. The present invention can be used to join wires of a lamp string together to form a net-like configuration.

2 Claims, 6 Drawing Sheets

STRUCTURE OF A WIRE CLIPPER FOR USING IN A NET-LIKE LAMP STRING

FIELD OF THE INVENTION

The present invention relates generally to a structure of a wire clipper for using in a net-like lamp string, such as a Christmas lamp string, and in particular to a wire clipper for securing wires of the lamp string together at desired positions so as to form for example a net-like configuration of the lamp string for enhancing the decorative effectiveness.

BACKGROUND OF THE INVENTION

Lamp string, such as those used in for example Christmas, are well known and widely used in holidays and festivals for making joyful atmosphere. The lamp strings usually comprises a set of wires that usually has two wires for supplying electricity and a plurality of lamp holders physically and electrically connected to the wires with lamp received and held herein. The wires, usually flexible, may be bent and deformed nearly arbitrarily to form any desired shape and configuration. Some of the manufacturers of the lamp shape provide the lamp strings in the net-like configuration so that the user can easily fix the lamp string on the house or tree. To make the net-like configuration, it needs to secure are least two sets of wires together at predetermined positioned along the wires and conventionally, this is done by providing a wire fixing means on the lamp holder that is mounted on a first set of wires so that a second set of wires may be fixed to the first get of wires by being secured by the wires fixing means on the lamp bolder.

However, such a design of securing the second set of wires to the lamp holder on the first set of the wires limits the locations where the two sets of wires may be jointed with each other.

Thus, it is desirable to provide a lamp string wires clipper which allows the wires to be secured together in such a way that the lamp holder and the lamp run substantially normal to the plane of the net like configuration of the lamp string and also allows the wires to the joined together at any desired positions along the wires.

SUMMARY OF THE INVENTION

Accordingly, the object of the present invention is to provide a lamp string wire clipper which may secure two sets of wires of the lamp string together in such a way that lamp clipper and the lamp mounted therein run substantially normal to the plane on which the two sets of wires are located.

Another object of the present invention is to provide a lamp string wire clipper which allows two sets of wires of the lamp string to be secured together by any desired positions along the wires.

Therefore, the present invention provides a lamp string wire clipper for joining two sets of wires of a lamp string together comprises a holder and a lamp seat. The holder is formed by a first portion and a second portion, the first portion includes three trenches, a pin and a convex portion, the second portion including three trenches, a pin hole and a convex portion. The lamp seat includes a through hole and a via hole. After assembling with a lamp, two electric wires connected with a lamp is inserted in the through hole, a set of trenches enclose the via hole so that the convex portions align with the hole opening, one end of one of the two electric wire passes through the through hole enclosing by the first trenches, a further electric wire passes through the through hole enclosed by the third trenches. The present invention can be used to join wires of a lamp string together to form a net-like configuration.

The various objects and advantages of the present invention will be more readily understood from the following detailed description when read in conjunction with the appended drawing.

DETAILED DESCRIPTION OF THE PREFERRED EMBODIMENTS

Figure 1:
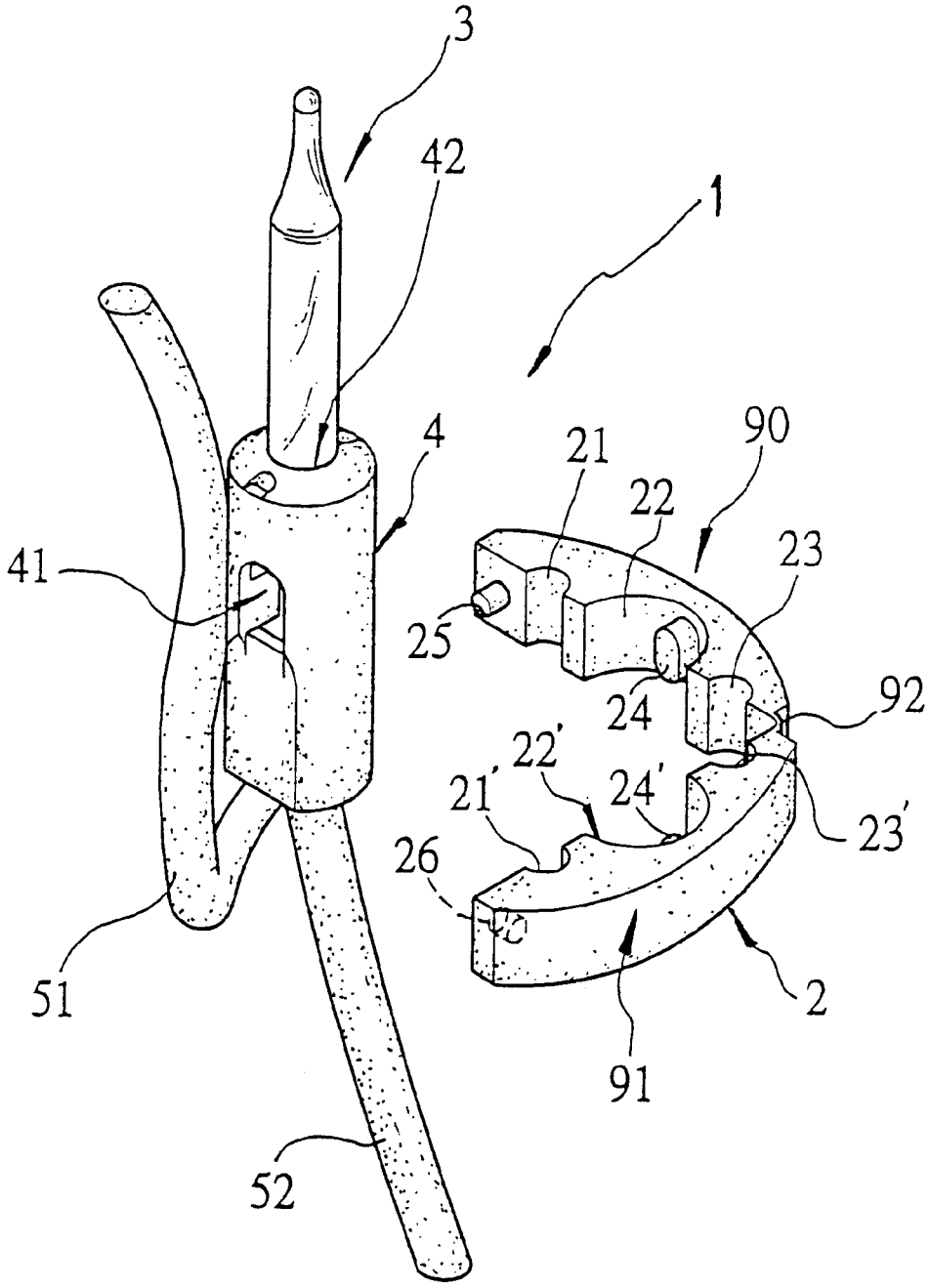
FIG. 1 is a exploded perspective view of the lamp string wire clipper according to the present invention.

Referring now to FIG. 1, the lamp string wire clipper 1 of the present invention is shown. The wire clipper 1 comprises a holder 2 and a lamp seat 4.

The holder 2 is formed by a first portion 90 and a second portion 91. The first portion 90 includes a first trench 21, a second trench 22, a third trench 23, a pin 25 and a convex portion 24. The second portion 91 includes a first trench 21', a second trench 22', a third trench 23', a pin hole 26 and a convex portion 24'. The first portion 90 and the second portion 91 are connected by a linkage 92.

Figure 2:
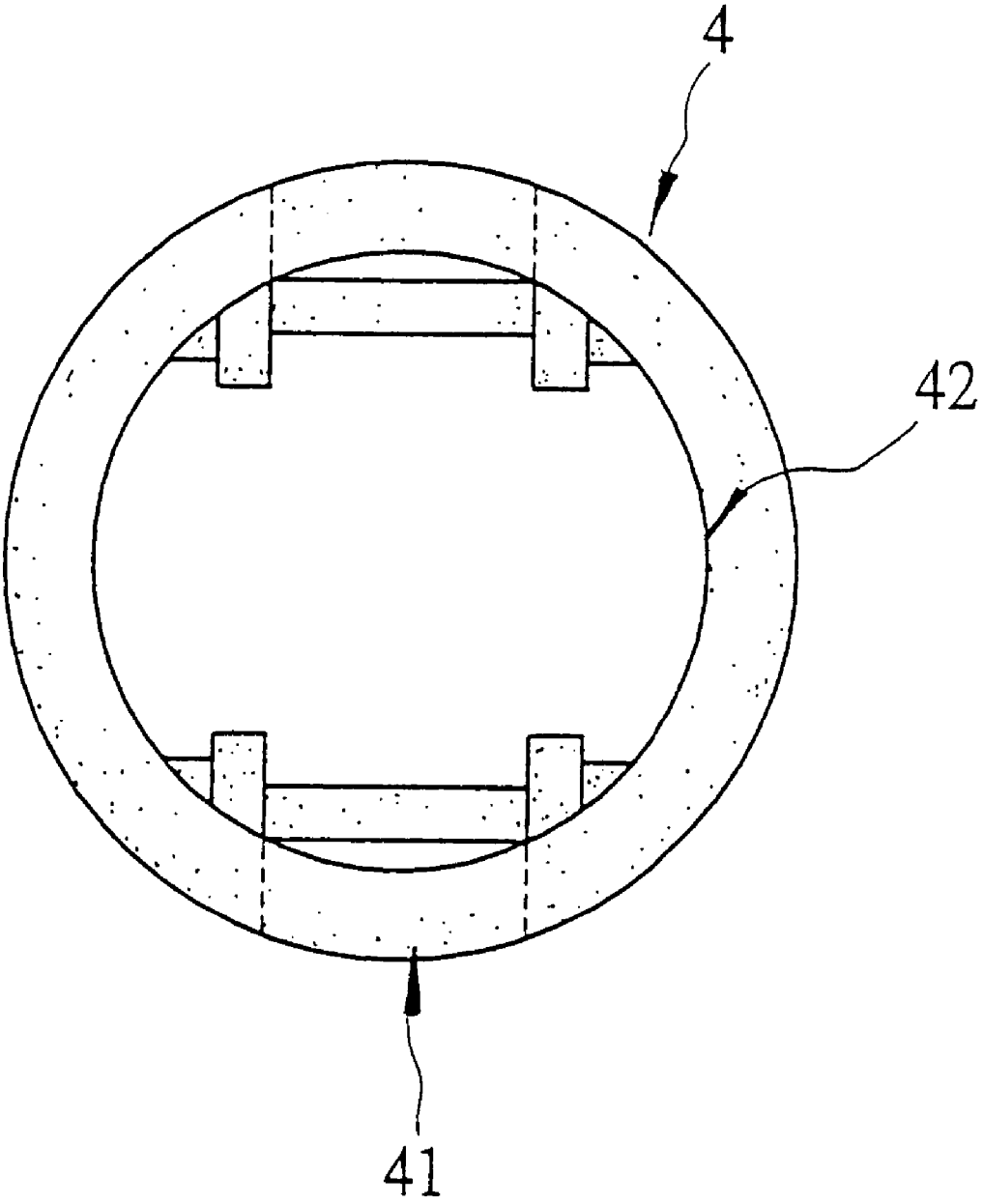
FIG. 2 is an elevation view of the lamp seat of the lamp string wire clipper according to the present invention.

The lamp seat 4 includes a through hole 42 and a via hole 41. The through hole penetrates the lamp seat 4 in the longitudinal direction, and the via hole 41 penetrates the lamp seat in the transversal direction. The two holes 41 and 42 are intersected with one another in the middle portion of the lamp seat 4. FIG. 2 shows an elevation view of the lamp seat 4.

The size of the second trenches 22 and 22' is slightly larger than the outer periphery of the lamp seat. The size of the first trenches 21 and 21' and the size of the third trenches 23 and 23' are larger than the electric wires used. The convex portions 24 and 24' are small than the opening of the via hole 41.

Figure 3:
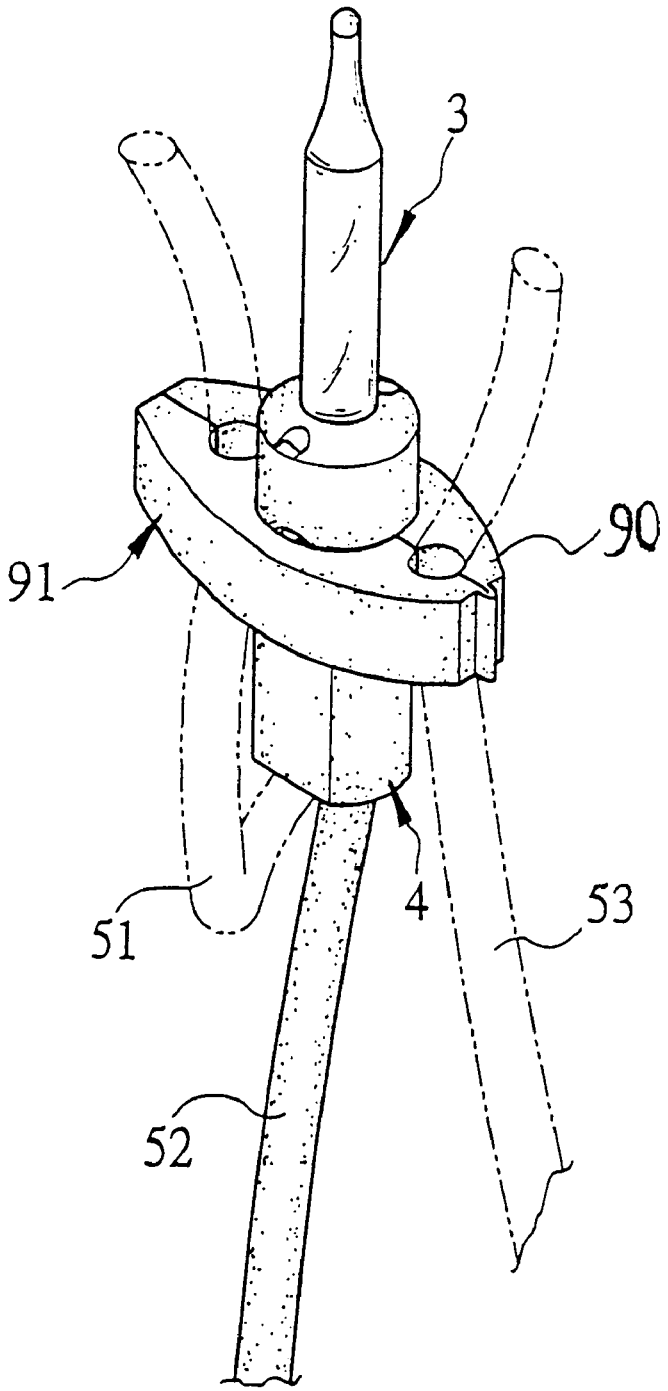
FIG. 3 is a perspective view showing that a lamp inserted within a lamp seat is assembled on the wire clipper of the present invention.

FIG. 3 shows an assembled view of the present invention. During assembling, two electric wires are firstly inserted into the through hole 42 and then are connected with the lamp 3. Then the lamp is inserted into the through hole 42 to be located therewithin. Next, the two wires are pulled out from the lower opening of the through hole 42. Next, the holder 2 loosely clamps the lamp seat 4 with the second trenches 22 and 22' encloses the via hole 41 so that the convex portions 24 and 24' will align with the hole opening. Then one end of the electric wire 51 passes through the through hole formed by the first trenches 21 and 21' from the lower portion as that shown in the figure. Then, an electric wire 53 passes through the through hole enclosed by the third trenches 23 and 23'. Finally, the first portion 90 and the second portion 91 are pinched tightly so that the pin 25 will insert into the pin hole 26, and meanwhile the convex portions 24 and 24' insert into the via holes 41 so as to tightly clamp the two electric wires 51 and 52. Therefore, the assembly of the lamp structure is complete. The assembled view is shown in FIG. 3.

In the present invention, the holder 2 and the lamp seat 4 are made of elastic deformable materials, perferably non-conductive such as plastic, so that the trenches and pin hole on the holder 2 are expandable by elastically deflecting. This allows that the lamp 3 can be inserted into the lamp seat 4.

Figure 4:
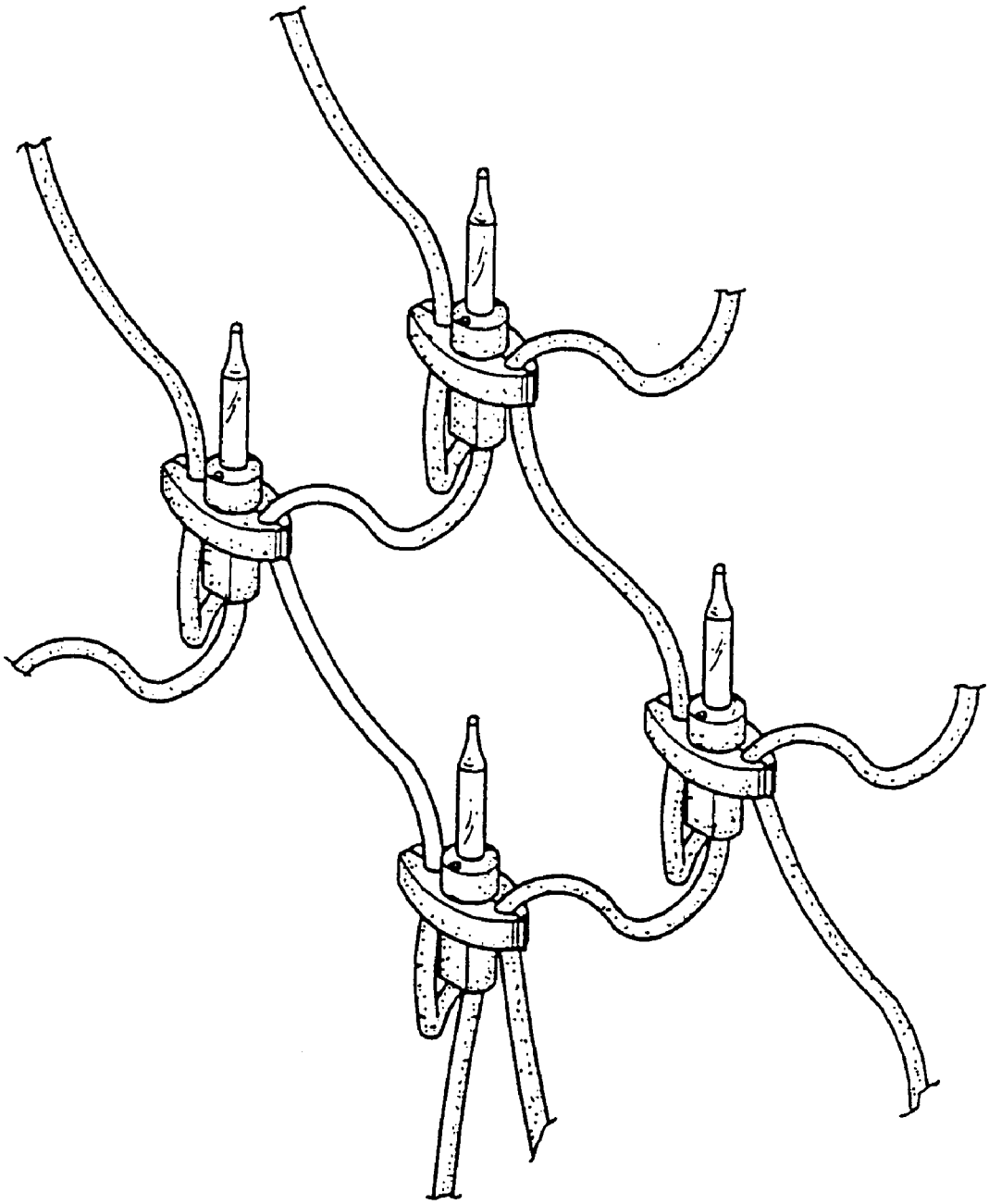
FIG. 4 shows an application of using the wire clipper of the present invention to join wires of a lamp string together to form a net-like configuration.

FIG. 4 shows an application of using the wire clipper 1 of the present invention to join wires of a lamp string together to form a net-like configuration.

Figure 5:
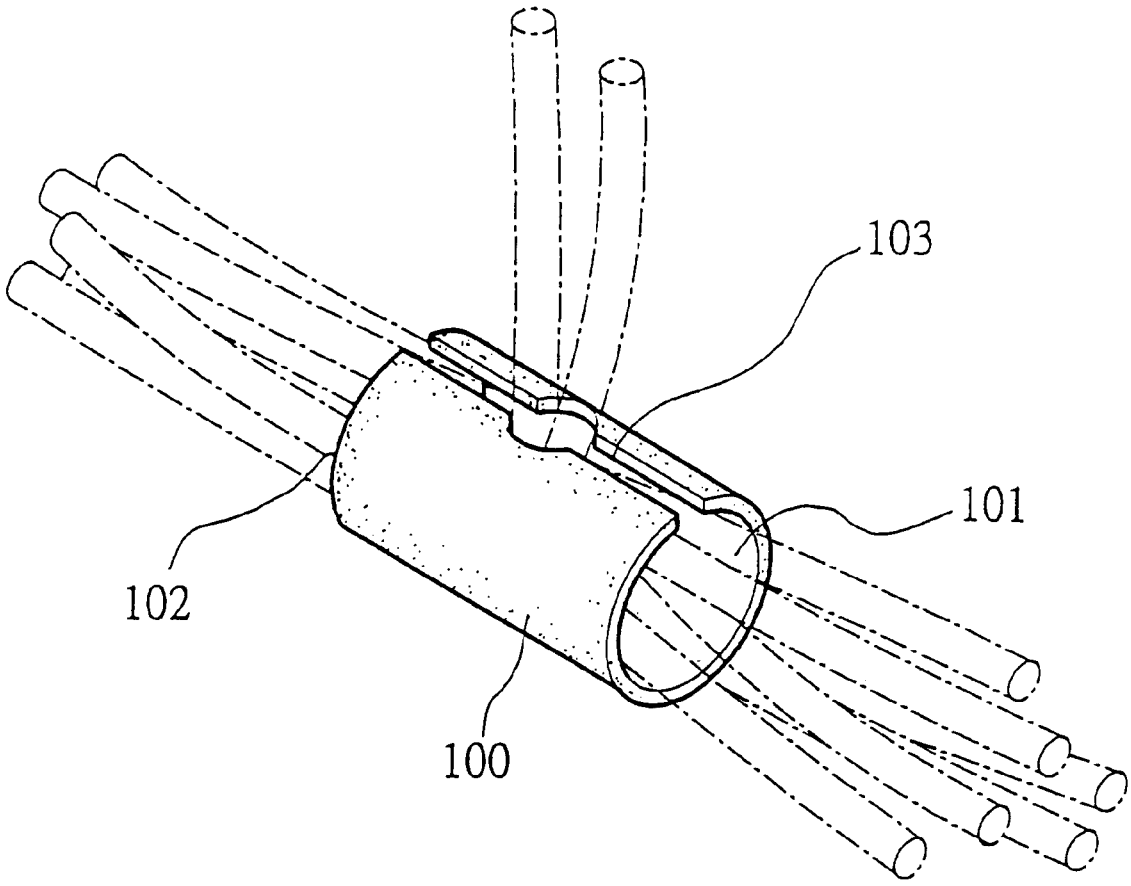
FIG. 5 shows a connector for connecting a bundle of wires together.
Figure 6:
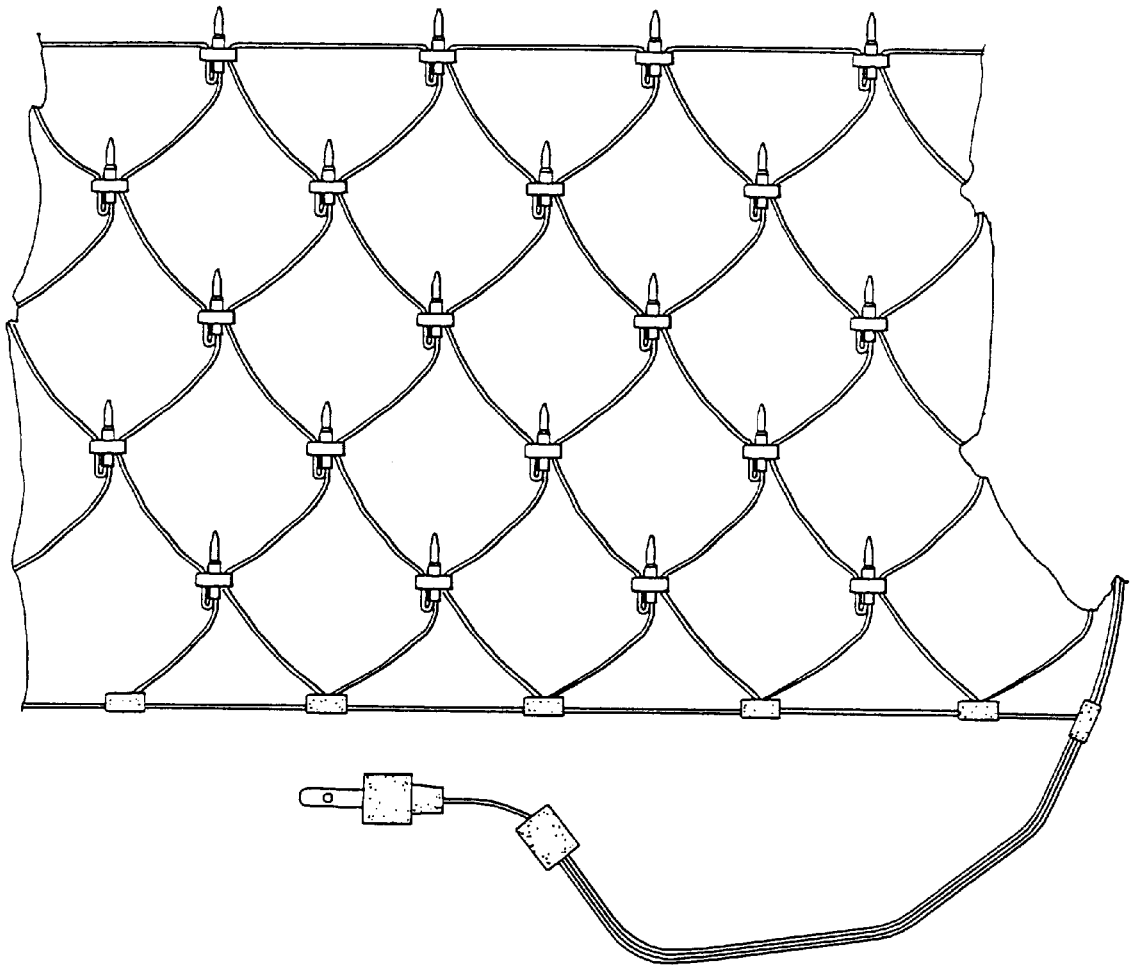
FIG. 6 shows the overall connections of a whole lamp string and two boundary wires.

FIG. 5 shows a connector for connecting a bundle of wires together. FIG. 6 shows the overall connections of a whole lamp string and two boundary wires. From FIGS. 5 and 6, it is shown the connector including two openings 101 and 102, and a slot 103 having a mouth portion on the middle thereof. By the connector 100, a bundle of wires can be connected through the connector, then the whole lamp string may be further connected as a net between two parallel wire.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A lamp string wire clipper for joining two sets of wires of a lamp string together, comprising:

a holder formed by a first portion and a second portion, the first portion including a first trench, a second trench, a third trench, a pin and a convex portion in the second trenches, the second portion including another first trench with respect to the first trench of the first portion, another second trench with respect to the second trench of the first portion, another third trench with respect to the third trench of the first portion, a pin hole and a convex portion in the another second trenches, the first portion and the second portion are connected by a linkage;

a lamp seat including a through hole and a via hole, the through hole penetrating the lamp seat in the longitudinal direction, and the via hole penetrating the lamp seat in the transversal direction, the via hole and the through hole being intersected with one another in the middle portion of the lamp seat;

wherein after assembling with a lamp, two electric wires connected with a lamp is inserted in the through hole, the second trenches encloses the via hole so that the convex portions align with the hole opening, one end of one of the two electric wire passes through a hole enclosing by the first trenches, a further electric wire passes through the hole enclosed by the third trenches, the first portion and the second portion are pinched tightly so that the pin inserts into the pin hole, and meanwhile the convex portions insert into the via holes to tightly clamp the two electric wires.

2. The lamp string wire clipper according to claim 1, wherein the holder and the lamp seat are made of elastic deformable and nonconductive materials.

* * * * *